US009080474B2

(12) United States Patent
Wigsten et al.

(10) Patent No.: US 9,080,474 B2
(45) Date of Patent: Jul. 14, 2015

(54) DUAL PHASERS ASSEMBLED CONCENTRICALLY ON A CONCENTRIC CAMSHAFT SYSTEM

(75) Inventors: Mark Wigsten, Lansing, NY (US); Michael W. Marsh, Dryden, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 13/981,976

(22) PCT Filed: Jan. 25, 2012

(86) PCT No.: PCT/US2012/022463

§ 371 (c)(1),
(2), (4) Date: Jul. 26, 2013

(87) PCT Pub. No.: WO2012/109013

PCT Pub. Date: Aug. 16, 2012

(65) Prior Publication Data

US 2013/0306011 A1 Nov. 21, 2013

Related U.S. Application Data

(60) Provisional application No. 61/440,901, filed on Feb. 9, 2011.

(51) Int. Cl.

| | |
|---|---|
| ***F01L 1/34*** | (2006.01) |
| ***F01L 1/344*** | (2006.01) |
| *F01L 1/047* | (2006.01) |

(52) U.S. Cl.

CPC ..... *F01L 1/3442* (2013.01); *F01L 2001/0475* (2013.01); *F01L 2001/34469* (2013.01); *F01L 2001/34493* (2013.01); *F01L 2250/02* (2013.01); *F01L 2250/04* (2013.01)

(58) Field of Classification Search

CPC ..... F01L 1/3442; F01L 2001/0475; F01L 2250/04; F01L 2001/34493; F01L 2250/02; F01L 2001/34469

USPC ..... 123/90.15, 90.17

See application file for complete search history.

(56) References Cited

U.S. PATENT DOCUMENTS 5,797,361 A 8/1998 Mikame et al.
5,836,275 A 11/1998 Sato (Continued)

FOREIGN PATENT DOCUMENTS

DE 102009041755 A1 * 4/2010 ..... F01L 1/344

*Primary Examiner* — Zelalem Eshete

(74) *Attorney, Agent, or Firm* — Helmholdt Law PLC; Thomas D. Helmholdt

(57) ABSTRACT

A variable cam timing phaser for an internal combustion engine having a concentric camshaft can include a stator (14) having an axis of rotation. An outer rotor (20) can rotate independently relative to the axis of rotation of the stator (14). A combination of an outer vane (22) and cavity (20*a*) can be associated with the outer rotor (20) to define first and second outer variable volume working chambers (20*b*, 20*c*). A radially inner located rotor (30) can rotate relative to the axis of rotation and independently of both the stator (14) and the outer rotor (20). A combination of an inner vane (32) and a cavity (30*a*) can be associated with the inner rotor (20) to define first and second inner variable volume working chambers (30*b*, 30*c*). When the first and second, outer and inner chambers (20*b*, 30*b*, 20*c*, 30*c*) selectively communicate with a source of pressurized fluid, phase orientation of the outer and inner rotors (20, 30) with respect to one another and with respect to the stator (14) is facilitated.

14 Claims, 4 Drawing Sheets

(56) References Cited

U.S. PATENT DOCUMENTS

| | | | | |
|---|---|---|---|---|
| 6,244,230 | B1 | 6/2001 | Mikame | |
| 6,725,817 | B2 | 4/2004 | Methley et al. | |
| 7,270,096 | B2 | 9/2007 | Lancefield et al. | |
| 7,421,989 | B2 | 9/2008 | Fischer et al. | |
| 7,444,968 | B2 | 11/2008 | Lancefield et al. | |
| 7,779,800 | B2 | 8/2010 | Methley et al. | |
| 7,789,054 | B2 | 9/2010 | Rozario et al. | |
| 7,841,311 | B2 | 11/2010 | Hutcheson et al. | |
| 7,975,663 | B2 | 7/2011 | Davis | |
| 2003/0196621 | A1 | 10/2003 | Lichti | |
| 2010/0050967 | A1 | 3/2010 | Lancefield et al. | |
| 2010/0089353 | A1 | 4/2010 | Myers et al. | |
| 2010/0093453 | A1* | 4/2010 | Myers et al. | 464/160 |
| 2010/0186698 | A1 | 7/2010 | Pluta | |
| 2013/0284132 | A1* | 10/2013 | Watanabe et al. | 123/90.15 |
| 2014/0102392 | A1* | 4/2014 | Busse | 123/90.17 |
| 2014/0190435 | A1* | 7/2014 | Wigsten et al. | 123/90.17 |

* cited by examiner

DUAL PHASERS ASSEMBLED CONCENTRICALLY ON A CONCENTRIC CAMSHAFT SYSTEM

FIELD OF THE INVENTION

The invention relates to a mechanism intermediate a crankshaft and a poppet-type intake or exhaust valve of an internal combustion engine for operating at least one such valve, wherein the mechanism varies the time period relative to the operating cycle of the engine, and more particularly, wherein the mechanism operably engages with a concentric camshaft to vary an angular position of one camshaft and an associated cam relative to another camshaft and associated cam.

BACKGROUND

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. A crankshaft can take power from the pistons to drive at least one transmission and at least one camshaft. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

As is conventional in the art, there can be one or more camshafts per engine. A camshaft can be driven by a belt, or a chain, or one or more gears, or another camshaft. One or more lobes can exist on a camshaft to push on one or more valves. A multiple camshaft engine typically has one camshaft for exhaust valves, one camshaft for intake valves. A "V" type engine usually has two camshafts (one for each bank) or four camshafts (intake and exhaust for each bank).

Variable cam timing (VCT) devices are generally known in the art, such as U.S. Pat. No. 7,841,311; U.S. Pat. No. 7,789,054; U.S. Pat. No. 7,270,096; U.S. Pat. No. 6,725,817; U.S. Pat. No. 6,244,230; and U.S. Published Application No. 2010/0050967. Known patents and publications disclose hydraulic couplings for single phaser assemblies in which an annular space is provided between a drive member concentrically surrounding a single driven member. The annular space is divided into segment-shaped or arcuate variable volume working chambers by one or more vanes extending radially inward from an inner surface of the drive member and one or more vanes extending radially outward from an outer surface of the single driven member. As hydraulic fluid is admitted into and expelled from the various chambers, the vanes rotate relative to one another and thereby vary the relative angular position of the drive member and the single driven member. Hydraulic couplings that use radial vanes to apply a tangentially acting force will be referred to herein as vane-type hydraulic couplings. Each of these prior known patents and publications appears to be suitable for its intended purpose. However, dual variable cam timing (VCT) devices with variable volume working chambers that are positioned axially spaced with respect to one another require additional axial space for the dual VCT assembly, while those dual VCT devices with variable volume working chambers that are positioned circumferentially spaced with respect to one another potentially suffer from reduced angular actuation distance of the associated rotor and vane, and can potentially suffer from reduced actuation force as a result of limited number of vanes, limited vane surface area, and limited actuation fluid chamber size. Therefore, it would be desirable to provide a configuration that requires less axial space for a dual VCT assembly. It would also be desirable to provide increased angular actuation distances for a dual VCT assembly. Further, it would be desirable to provide increased actuation force capabilities for a dual VCT assembly.

SUMMARY

A dual variable cam timing phaser can be driven by power transferred from an engine crankshaft and delivered to a concentric camshaft having a radially inner shaft and a radially outer shaft for manipulating two sets of cams. The phaser can include a drive stator connectible for rotation with an engine crankshaft and two concentric driven rotors, each rotor connectible for rotation with a respective one shaft of the concentric camshaft supporting the corresponding two sets of cams. The drive stator and the driven rotors are all mounted for rotation about a common axis. The driven rotors are coupled for rotation with the drive stator by a plurality of radially stacked, (as opposed to axially stacked or circumferentially stacked), vane-type hydraulic couplings to enable the phase of the driven rotors to be adjusted independently of one another relative to the drive stator. It should be recognized that this configuration requires less axial space for a dual VCT assembly. Furthermore, this configuration can provide increased angular actuation distances for a dual VCT assembly. This configuration can also provide increased actuation force capabilities for a dual VCT assembly.

A dual variable cam timing phaser for an internal combustion engine having a concentric camshaft with a radially inner shaft and a radially outer shaft can include a stator having an axis of rotation. An outer rotor can be rotatable relative to the axis of rotation of the stator independently of the stator. A radially outer located vane-type hydraulic coupling can include a combination of an outer vane and cavity associated with the outer rotor to define first and second outer variable volume working chambers. An inner rotor can be rotatable relative to the axis of rotation of the stator independently of both the stator and the outer rotor. The inner rotor can be located radially inwardly within an innermost periphery of the outer rotor. A radially inner located vane-type hydraulic coupling can include a combination of an inner vane and cavity associated with the inner rotor to define first and second inner variable volume working chambers. A plurality of fluid passages can connect the first and second, outer and inner working chambers with respect to a source of pressurized fluid for facilitating angular phase orientation of the outer and inner rotors independently with respect to each other and independently with respect to the stator.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
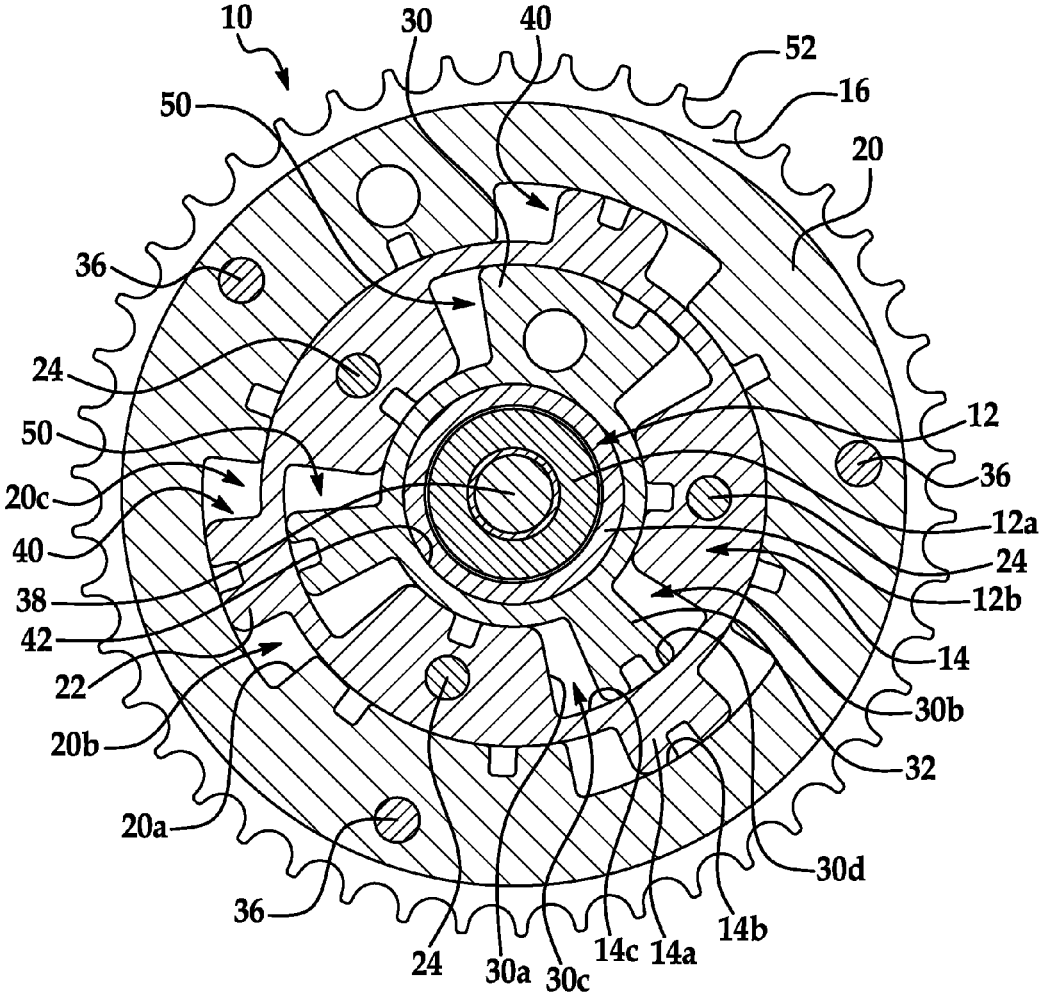
FIG. 1 is a cross sectional view taken transverse to an axis of rotation of a dual variable cam timing phaser for an internal combustion engine having a concentric camshaft according to the present invention.
Figure 2:
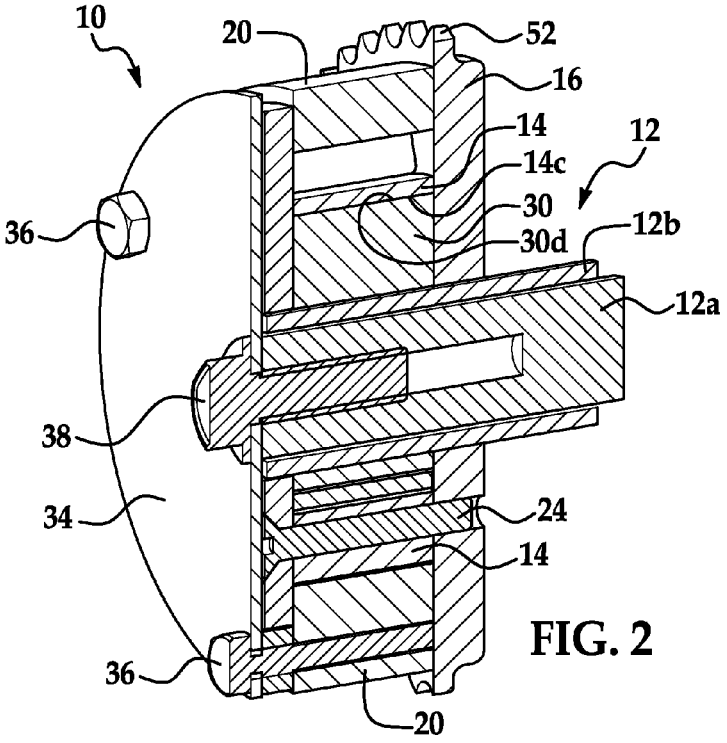
FIG. 2 is a cross sectional view taken along an axis of rotation of the dual variable cam timing phaser of FIG. 1.
Figure 3:
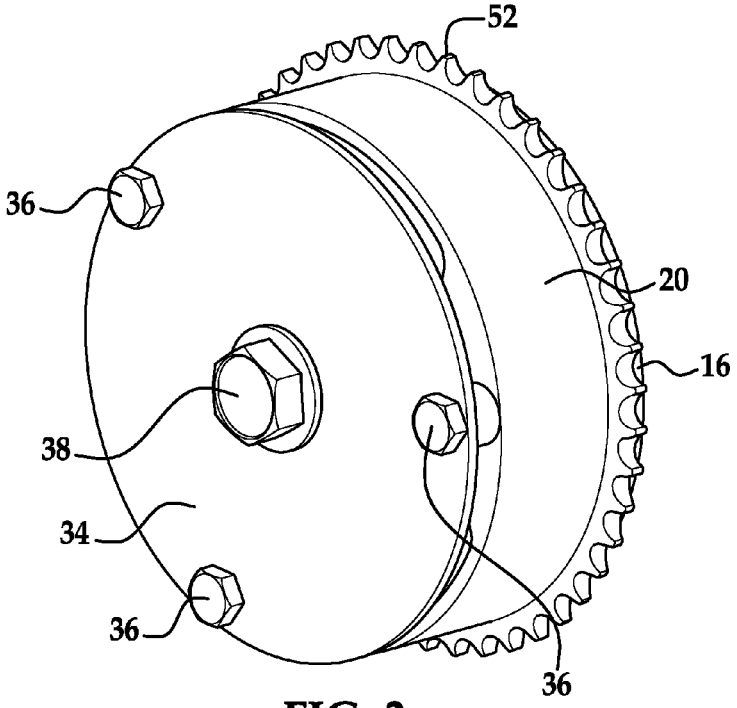
FIG. 3 is a perspective end view of the dual variable cam timing phaser of FIGS. 1-2.

Referring now to FIGS. 1-3, a dual variable cam timing phaser 10 can be driven by power transferred from an engine crankshaft (not shown) to be delivered to a concentric camshaft 12 for manipulating two sets of cams (not shown). A portion of a variable cam timing (VCT) assembly 10 is illustrated including the concentric camshaft 12 having an inner shaft 12*a* and an outer shaft 12*b*. Primary rotary motion can be transferred to the concentric camshaft 12 through the sprocket ring 52 of annular flange 16 operably associated with drive stator 14. Secondary rotary motion, or phased relative rotary motion between inner camshaft 12*a* and outer camshaft 12*b*, can be provided by the dual variable cam timing phaser 10. The phaser 10 can include the drive stator 14 to be connected by an endless loop, flexible, power transmission member for rotation with the engine crankshaft. Two concentric driven rotors 20, 30 can be associated with the stator 14. Each rotor 20, 30 can be connected for rotation with a respective one shaft 12*a*, 12*b* of the concentric camshaft 12 supporting the corresponding two sets of cams. The drive stator 14 and the driven rotors 20, 30 are all mounted for rotation about a common axis. A plurality of radially stacked, vane-type hydraulic couplings 40, 50 for coupling the driven rotors 20, 30 for rotation with the drive stator 14 enable the phase of the driven rotors 20, 30 to be adjusted independently of one another relative to the drive stator 14.

The plurality of radially stacked, vane-type hydraulic couplings can include a radially outer located vane-type hydraulic coupling 40 and a radially inner located vane-type hydraulic coupling 50. The radially outer located vane-type hydraulic coupling 40 can include at least one radially outer located vane 22 and at least one corresponding radially outer located cavity 20*a* associated with the radially outer located rotor 20 to be divided by the at least one radially outer located vane 22 into a first outer variable volume working chamber 20*b* and a second outer variable volume working chamber 20*c*. The radially inner located vane-type hydraulic coupling 50 can include at least one radially inner located vane 32 and at least one corresponding radially inner located cavity 30*a* adjacent the radially inner located rotor 30 to be divided by the at least one radially inner located vane 32 into a first inner variable volume working chamber 30*b* and a second inner variable volume working chamber 30*c*.

The radially outer located vane-type hydraulic coupling 40 can include a combination of an outer vane 22 and cavity 20*a* associated with the outer rotor 20 to define first and second outer variable volume working chambers 20*b*, 20*c*. The combination of the outer vane 22 and cavity 20*a* can be defined by the stator 14 having a wall portion 14*a* with a radially outer surface 14*b* defining the outer vane 22, and the outer rotor 20 surrounding the radially outer surface 14*b* of the stator 14 to define the outer cavity 20*a*. The radially inner located vane-type hydraulic coupling 50 can include a combination of an inner vane 32 and cavity 30*a* associated with the inner rotor 30 to define first and second inner variable volume working chambers 30*b*, 30*c*. The combination of the inner vane 32 and cavity 30*a* can be defined by the stator 14 having a wall 14*a* with a radially inner surface 14*c* defining the inner cavity 30*a*, and the inner rotor 30 having an outer surface 30*d* defining the inner vane 32.

As best seen in FIGS. 1 and 2, the drive stator 14 is connected to the annular flange 16 and associated sprocket ring 52 through fasteners 24. Outer rotor 20 is connected to inner concentric camshaft 12*a* through end plate 34, outer fasteners 36 and central fastener 38. Inner rotor 30 is directly connected to an outer surface 42 of outer concentric camshaft 12*b*.

In operation, a dual variable cam timing phaser 10 provides radially outer annular spaces or cavities 20*a* and radially inner annular spaces or cavities 30*a* with respect to the drive stator 14 and the concentrically located driven outer and inner rotors 20, 30. The annular spaces or cavities 20*a*, 30*a* are divided into segment-shaped or arcuate variable volume working chambers 20*b*, 20*c*, 30*b*, 30*c* by outer and inner vanes 22, 32 extending radially from a surface of the outer and inner rotors 20, 30 and one or more vanes or walls 18 extending radially from a surface of the drive stator 14. As hydraulic fluid is admitted into and expelled from the various chambers 20*b*, 20*c*, 30*b*, 30*c*, the vanes 22, 32 rotate relative to one another and thereby vary the relative angular position of the driven outer and inner rotors 20, 30 with respect to each other and with respect to the stator 14.

Figure 4:
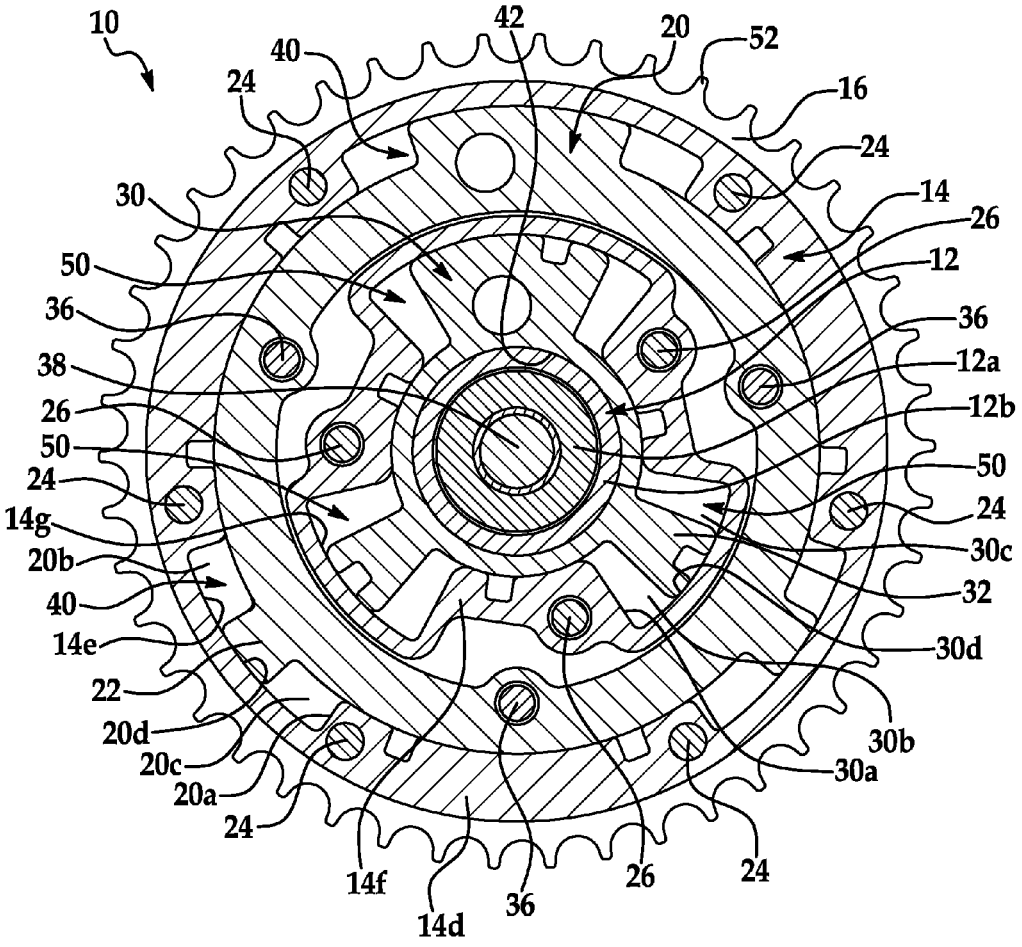
FIG. 4 is a cross sectional view taken transverse to an axis of rotation of a dual variable cam timing phaser for an internal combustion engine having a concentric camshaft according to another configuration of the present invention.
Figure 5:
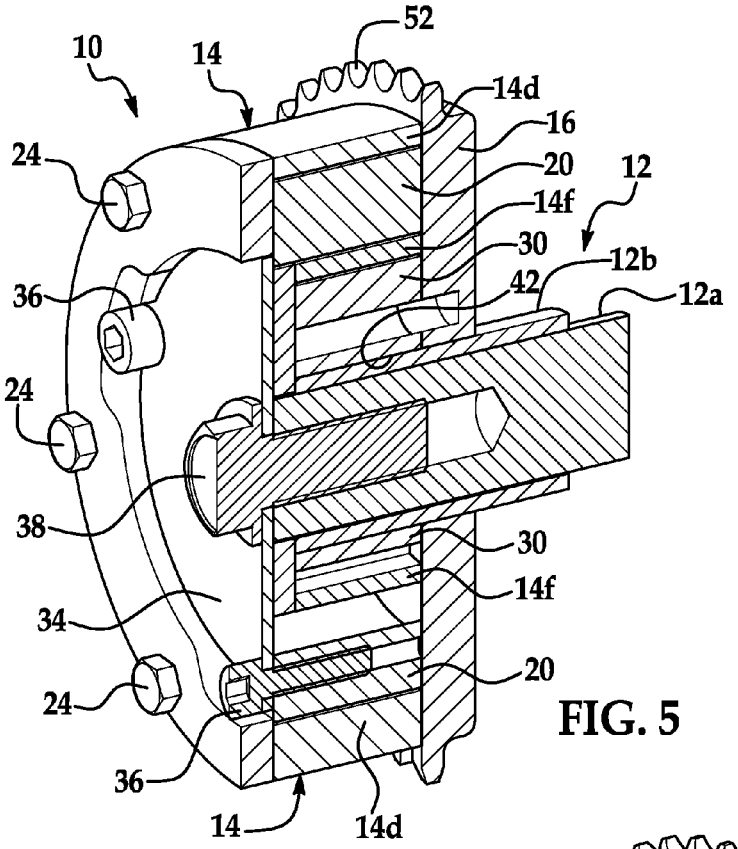
FIG. 5 is a cross sectional view taken along an axis of rotation of the dual variable cam timing phaser of FIG. 4.
Figure 6:
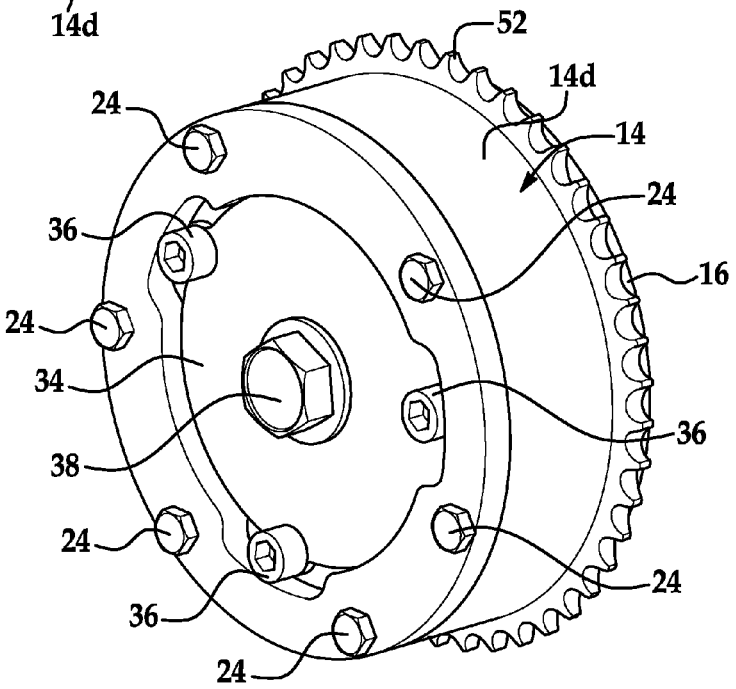
FIG. 6 is a perspective end view of the dual variable cam timing phaser of FIGS. 4-5.

Referring now to FIGS. 4-6, and as previously described with respect to FIGS. 1-3, a dual variable cam timing phaser 10 can be driven by power transferred from an engine crankshaft (not shown) to be delivered to a concentric camshaft 12 for manipulating two sets of cams (not shown). A portion of a variable cam timing (VCT) phaser assembly 10 is illustrated including the concentric camshaft 12 having an inner camshaft 12*a* and an outer camshaft 12*b*. Primary rotary motion can be transferred to the concentric camshaft 12 through the assembly of sprocket ring 52 to annular flange 16 operably associated with drive stator 14. Secondary rotary motion, or phased relative rotary motion between inner camshaft 12*a* and outer camshaft 12*b*, can be provided by the dual variable cam timing phaser 10. The phaser 10 can include the drive stator 14 to be connected for rotation with the engine crankshaft. Two concentric driven rotors 20, 30 can be associated with the stator 14. Each rotor 20, 30 can be connected for rotation with a respective one of the concentric camshafts 12 supporting the corresponding two sets of cams. The drive stator 14 and the driven rotors 20, 30 are all mounted for rotation about a common axis. A plurality of radially stacked, vane-type hydraulic couplings 40, 50 for coupling the driven rotors 20, 30 for rotation with the drive stator 14 enable the phase of the driven rotors 20, 30 to be adjusted independently of one another relative to the drive stator 14. In this configuration, the stator 14 includes a radially outer wall portion 14*d*, and a radially inner wall portion 14*f*.

The plurality of radially stacked, vane-type hydraulic couplings can include a radially outer located vane-type hydraulic coupling 40 and a radially inner located vane-type hydraulic coupling 50. The radially outer located vane-type hydraulic coupling 40 can include at least one radially outer located vane 22 and at least one corresponding radially outer located cavity 20*a* associated with the radially outer located rotor 20 to be divided by the at least one radially outer located vane 22 into a first outer variable volume working chamber 20*b* and a second outer variable volume working chamber 20*c*. The radially inner located vane-type hydraulic coupling 50 can include at least one radially inner located vane 32 and at least one corresponding radially inner located cavity 30*a* adjacent the radially inner located rotor 30 to be divided by the at least one radially inner located vane 32 into a first inner variable volume working chamber 30*b* and a second inner variable volume working chamber 30*c*.

The radially outer located vane-type hydraulic coupling 40 can include a combination of an outer vane 22 and cavity 20*a* associated with the outer rotor 20 to define first and second outer variable volume working chambers 20*b*, 20*c*. The combination of the outer vane 22 and cavity 20*a* can be defined by the stator 14 having a radially outer wall portion 14*d* with an inner surface 14*e* defining the outer cavity 20*a*, and the outer rotor 20 having an outer surface 20*d* defining the outer vane 22. The radially inner located vane-type hydraulic coupling 50 can include a combination of an inner vane 32 and cavity 30*a* associated with the inner rotor 30 to define first and second inner variable volume working chambers 30*b*, 30*c*. The combination of the inner vane 32 and cavity 30*a* can be defined by the stator 14 having a radially inner wall portion 14*f* interposed radially between the outer rotor 20 and the inner rotor 30. The inner wall portion 14*f* can have a radially inner surface 14*g* defining the inner cavity 30*a*, and the inner rotor 30 can have an outer surface 30*d* defining the inner vane 32.

As best seen in FIGS. 4-5, the outer wall portion 14*d* of drive stator 14 is connected to the flange 16 and associated sprocket ring 52 through fasteners 24. Outer rotor 20 is connected to inner concentric camshaft 12*a* through end plate 34, outer fasteners 36, and central fastener 38. The inner wall portion 14*f* of drive stator 14 is connected to the flange 16 and associated sprocket ring 52 through fasteners 26. The inner rotor 30 is connected directly to an outer surface 42 of the outer concentric camshaft 12*b*.

In operation, a dual variable cam timing phaser assembly provides radially outer annular spaces or cavities 20*a* and radially inner annular spaces or cavities 30*a* with respect to the drive stator 14 and the concentrically located driven outer and inner rotors 20, 30. The annular spaces or cavities 20*a*, 30*a* are divided into segment-shaped or arcuate variable volume working chambers 20*b*, 20*c*, 30*b*, 30*c* by outer and inner vanes 22, 32 extending radially from a surface of the outer and inner rotors 20, 30 and one or more vanes or walls 18 extending radially from a surface of the drive stator 14. As hydraulic fluid is admitted into and expelled from the various chambers 20*b*, 20*c*, 30*b*, 30*c*, the vanes 22, 32 rotate relative to one another and thereby vary the relative angular position of the driven outer and inner rotors 20, 30 with respect to each other and with respect to the stator 14.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A variable cam timing phaser (10) for an internal combustion engine having a concentric camshaft (12) comprising:

a stator (14) having an axis of rotation and a wall portion (14*a*, 14*f*) connected to the stator (14);

an outer rotor (20) rotatable relative to the axis of rotation of the stator (14) independently of the stator (14);

a radially outer located vane-type hydraulic coupling (40) including a combination of an outer vane (22) and outer cavity (20*a*) associated with the outer rotor (20) to define first and second outer variable volume working chambers (20*b*, 20*c*);

an inner rotor (30) rotatable relative to the axis of rotation of the stator (14) independently of both the stator (14) and the outer rotor (20), the inner rotor located radially inwardly within an innermost periphery of the outer rotor (20), the wall portion (14*a*, 14*f*) of the stator (14) radially interposed between the inner rotor (20) and outer rotor (30);

a radially inner located vane-type hydraulic coupling (50) including a combination of an inner vane (32) and inner cavity (30*a*) associated with the inner rotor (30) to define first and second inner variable volume working chambers (30*b*, 30*c*); and wherein the first and second, outer and inner, variable volume working chambers (20*b*, 30*b*, 20*c*, 30*c*), when selectively communicating with a source of pressurized fluid, facilitate angular phase orientation of the outer and inner rotors (20, 30) independently with respect to each other and independently with respect to the stator (14).

2. The variable cam timing phaser (10) of claim 1 further comprising:

the combination of the outer vane (22) and the outer cavity (20*a*) defined by the stator (14) having the wall portion (14*a*) with a radially outer surface (14*b*) defining the outer vane (22), and the outer rotor (20) surrounding the radially outer surface (14*b*) of the stator (14) to define the outer cavity (20*a*).

3. The variable cam timing phaser (10) of claim 1 further comprising:

the combination of the inner vane (32) and the inner cavity (30*a*) defined by the stator (14) having the wall portion (14*a*) with a radially inner surface (14*c*) defining the inner cavity (30*a*), and the inner rotor (30) having an outer surface (30*d*) defining the inner vane (32).

4. The variable cam timing phaser (10) of claim 1 further comprising:

the combination of the outer vane (22) and the outer cavity (20*a*) defined by the stator (14) having a radially outer wall portion (14*d*) with an inner surface (14*e*) defining the outer cavity (20*a*), and the outer rotor (20) having an outer surface (20*d*) defining the outer vane (22).

5. The variable cam timing phaser (10) of claim 1 further comprising:

the combination of the inner vane (32) and the inner cavity (30*a*) defined by the wall portion (14*f*) of the stator (14) having a radially inner surface (14*g*) defining the inner cavity (30*a*), and the inner rotor (30) having an outer surface (30*d*) defining the inner vane (32).

6. The variable cam timing phaser (10) of claim 1 further comprising:

the combination of the outer vane (22) and the outer cavity (20*a*) defined by the stator (14) having the wall portion (14*a*) with a radially outer surface (14*b*) defining the outer vane (22), and the outer rotor (20) surrounding the radially outer surface (14*b*) of the stator (14) to define the outer cavity (20*a*); and the combination of the inner vane (32) and the inner cavity (30*a*) defined by the stator (14) having the wall portion (14*a*) with a radially inner surface (14*c*) defining the inner cavity (30*a*), and the inner rotor (30) having an outer surface (30*d*) defining the inner vane (32).

7. The variable cam timing phaser (10) of claim 1 further comprising:

the combination of the outer vane (22) and the outer cavity (20*a*) defined by the stator (14) having a radially outer wall (14*d*) with an inner surface (14*e*) defining the outer cavity (20*a*), and the outer rotor (20) having an outer surface (20*d*) defining the outer vane (22); and the combination of the inner vane (32) and the inner cavity (30*a*) defined by the stator (14) having the wall portion (14*f*) interposed radially between the outer rotor (20) and the inner rotor (30), the wall portion (14*f*) of the stator (14) having a radially inner surface (14*g*) defining the inner cavity (30*a*), and the inner rotor (30) having an outer surface (30*d*) defining the inner vane (32).

8. The variable cam timing phaser (10) of claim 1 further comprising:

the wall portion (14*a*, 14*f*) defining at least a portion of at least one of the radially outer located vane-type hydraulic coupling (40) and the radially inner located vane-type hydraulic coupling (50).

9. The variable cam timing phaser (10) of claim 1 further comprising:

the wall portion (14*a*, 14*f*) defining at least a portion of both of the radially outer located vane-type hydraulic coupling (40) and the radially inner located vane-type hydraulic coupling (50).

10. A variable cam timing phaser (10) for an internal combustion engine having at least one concentric camshaft (12) comprising:

a stator (14) having an axis of rotation;

a radially outer located rotor (20) connectible to a first shaft of a concentric camshaft and disposed to rotate relative to the axis of rotation of the stator (14) independently of the stator (14);

a radially outer located vane-type hydraulic coupling (40) including at least one radially outer located vane (22) and at least one corresponding radially outer located cavity (20*a*) associated with the radially outer located rotor (20) to be divided by the at least one radially outer located vane (22) into a first outer variable volume working chamber (20*b*) and a second outer variable volume working chamber (20*c*);

a radially inner located rotor (30) connectible to a second shaft of the concentric camshaft and disposed to rotate relative to the axis of rotation of the stator (14) independently of both the stator (14) and the radially outer located rotor (20);

a radially inner located vane-type hydraulic coupling (50) including at least one radially inner located vane (32) and at least one corresponding radially inner located cavity (30*a*) adjacent the radially inner located rotor (30) to be divided by the at least one radially inner located vane (32) into a first inner variable volume working chamber (30*b*) and a second inner variable volume working chamber (30*c*), the stator (14) having a radially inner wall portion (14*a*, 14*f*) attached thereto, the radially inner wall portion being interposed radially between the outer rotor (20) and the inner rotor (30); and wherein the first and second outer variable volume working chambers (20*b*, 20*c*) and the first and second inner variable volume working chambers (30*b*, 30*c*), when selectively communicating with a source of pressurized fluid, facilitate phase orientation of the radially outer located rotor (20) and the radially inner located rotor (30) independently with respect to one another and independently with respect to the stator (14).

11. The variable cam timing phaser (10) of claim 10 further comprising:

the stator (14) having the wall portion (14*a*) with a radially inner surface (14*c*) defining the at least one radially inner located cavity (30*a*), and the inner rotor (30) having a radially outer surface (30*d*) defining the at least one radially inner located vane (22).

12. The variable cam timing phaser (10) of claim 10 further comprising:

the stator (14) having a radially outer wall portion (14*d*) with an inner surface (14*e*) defining the at least one radially outer located cavity (20*a*), and the outer rotor (20) having a radially outer surface (20*d*) defining the at least one radially outer located vane (22).

13. The variable cam timing phaser (10) of claim 12 further comprising:

the wall portion (14*f*) of the stator (14) having a radially inner surface (14*g*) defining the at least one radially inner located cavity (30*a*), and the inner rotor (30) having a radially outer surface (30*d*) defining the at least one inner vane (32).

14. A dual variable cam timing phaser (10) driven by power transferred from an engine crankshaft and delivered to a concentric camshaft (12) having a radially inner shaft (12*a*) and a radially outer shaft (12*b*) for manipulating two sets of cams, the phaser (10) comprising:

a drive stator (14) connectible for rotation with an engine crankshaft;

two concentric driven rotors (20, 30) associated with the stator (14), each rotor (20, 30) connectible for rotation with a respective one shaft of the concentric camshaft (12) supporting two sets of cams, wherein the drive stator (14) and the driven rotors (20, 30) are all mounted for rotation about a common axis, the drive stator (14) having a wall portion (14*a*, 14*f*) radially interposed between the two concentric driven rotors, at least one of the two concentric driven rotors disposed radially outward with respect to the other of the two concentric driven rotors (20, 30); and a plurality of radially stacked, vane-type hydraulic couplings (40, 50) for coupling the driven rotors (20, 30) for rotation with the drive stator (14) to enable the phase of the driven rotors (20, 30) to be adjusted independently of one another relative to the drive stator (14).

* * * * *